US007503725B1

(12) United States Patent
Pratt et al.

(10) Patent No.: US 7,503,725 B1
(45) Date of Patent: Mar. 17, 2009

(54) SUBSURFACE DRAINAGE SYSTEM

(76) Inventors: James M. Pratt, P.O. Box 920624, Needham, MA (US) 02492; A. Charles Wilmot, 103 Hillcrest Rd., Needham, MA (US) 02492; Anthony P. Nickinello, Jr., 4960 Almaden Expressway, San Jose, CA (US) 95118

( * ) Notice: Subject to any disclaimer, the term of this patent is extended or adjusted under 35 U.S.C. 154(b) by 0 days.

(21) Appl. No.: 11/893,963

(22) Filed: Aug. 20, 2007

(51) Int. Cl.
*E02B 13/00* (2006.01)

(52) U.S. Cl. ..... 405/50; 405/45; 210/170.03

(58) Field of Classification Search ..... 405/36, 405/37, 43–45, 52; 138/123; 210/170.01, 210/170.03

See application file for complete search history.

(56) References Cited

U.S. PATENT DOCUMENTS 4,460,292 A * 7/1984 Durham et al. ..... 588/252
6,142,703 A * 11/2000 Wilmot et al. ..... 405/43

* cited by examiner

*Primary Examiner*—Tara L. Mayo
(74) *Attorney, Agent, or Firm*—William Nitkin

(57) ABSTRACT

A subsurface water drainage system which includes a high porosity cylinder made of a mixture of Portland cement and activated charcoal, such cylinder disposed vertically in the subsoil to receive water discharge therein and to direct such water through its porous midsection into adjacent subsoil at a rate sufficient for dispersing the water to prevent yard surface flooding.

4 Claims, 1 Drawing Sheet

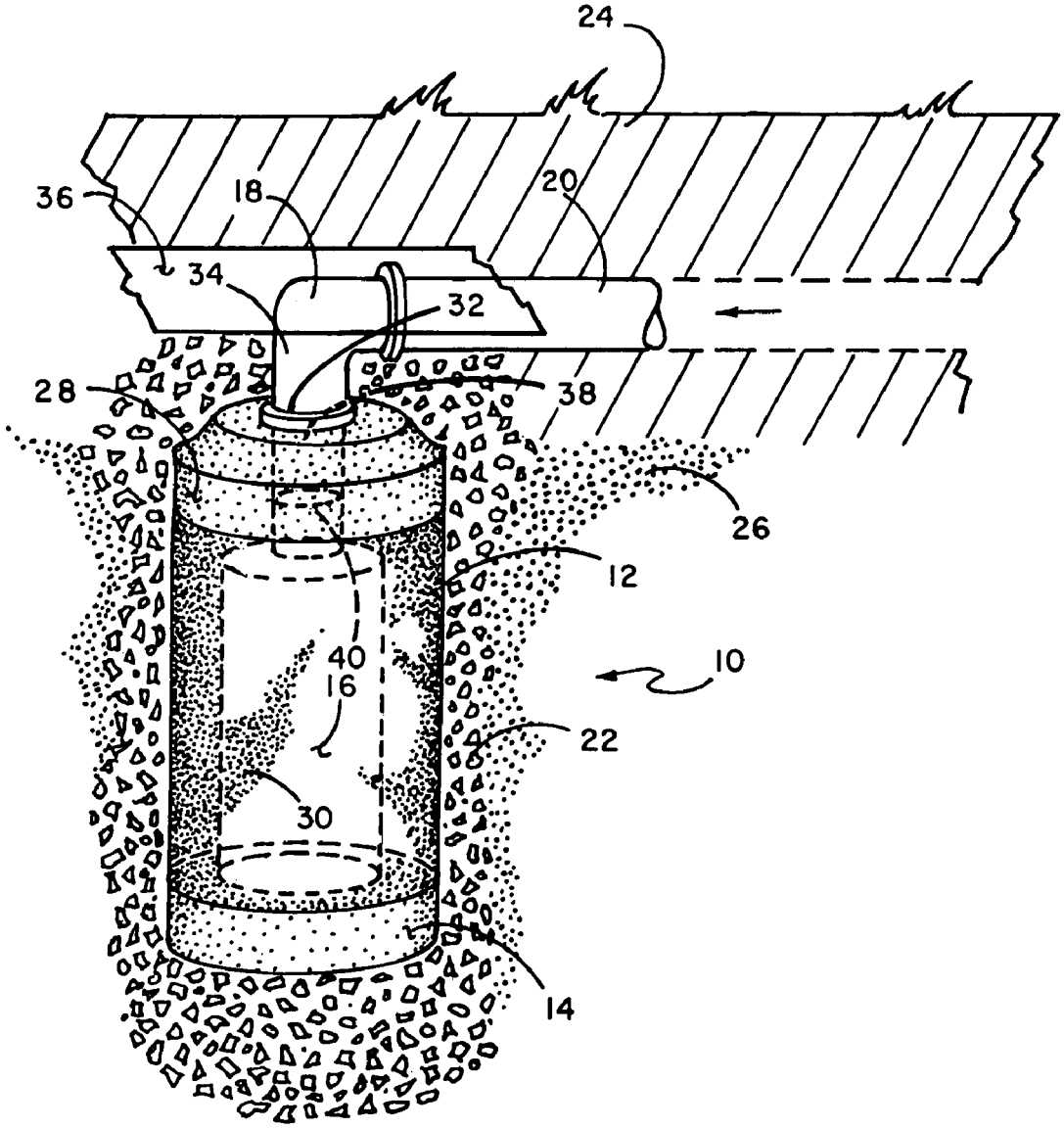
24
36
18
20
34
32
28
38
26
12
40
16
10
22
30
14

SUBSURFACE DRAINAGE SYSTEM

BACKGROUND OF THE INVENTION

1. Field of the Invention

The system of this invention resides in the area of water drainage systems and more particularly relates to an underground water discharge system that receives water drainage from such sources as a building's roof gutter through down spout extensions, underground pipes, sump pump discharges and the like that are directed to an underground pipe and then disperses such water drainage underground into the subsoil to prevent surface flooding and provide deep-root irrigation to plants.

2. History of the Prior Art

In many buildings, such as home dwellings, water drainage from the roof gutter system through down spouts and their extensions as well as sump pump drainage and the like can cause an excess of water to accumulate on the surface of the ground that the soil of the home's yard cannot readily absorb, thereby causing undesirable flooding of yard areas around the home. This flooding is a nuisance to homeowners and is not only unsightly, but also in some cases can damage plants, rot building structures and destroy carefully maintained lawns. To combat and prevent such flooding many homeowners install dry wells which are subsurface storage facilities that receive and store water runoff from roofs and/or sump pumps. The discharge of this stored runoff from dry wells occurs through infiltration into the surrounding soil. Dry wells can be structural chambers as well as excavated pits. Sometimes these pits are filled with aggregate, but they tend to soak up water from surrounding areas and become over saturated, rendering them useless. Dry wells can only be used where sub grade soils have sufficient permeability rates. If the dry well is not effective, anaerobic conditions can result, leading to odor and water quality problems and even the promotion of mosquito breeding. The soil around dry wells must therefore be sufficiently permeable to allow a reasonable rate of water infiltration.

The construction of dry wells is well known in the art and in one simple embodiment can be a pit surrounded by a number of cement blocks arrayed in a circle, often in an arrangement that has the blocks positioned closer and narrowed near the top of the pit, so that a conical structure is created. There is no particularly desirable form for such simple dry wells. In some cases dry wells can be plastic, barrel-like structures, in some instances made of polyethylene, and have a plurality of large apertures, such apertures being several inches in diameter formed therein to promote drainage into gravel placed therearound. In some instances a series of dry wells are utilized, one flowing into another. Some dry well structures can be surrounded with a porous, filter-type, geo-tech fabric wrap to keep soil from entering into the dry well. They can be surrounded with stone aggregate to increase the leaching capacity of the water into the subsurface soil. Dry wells not only can have an underground water inlet, but also can be provided with surface drains and vents to the surface of the ground. Dry wells are not used for any kind of sewerage and have quite different specifications from those of septic systems. Dry wells are generally placed beneath the surface in areas where vehicles or other heavy objects will not interfere with their operation.

One of the co-inventors herein is a co-inventor of U.S. Pat. No. 6,142,703 for an Encapsulated Turf Maintenance System which discloses elongated, porous conduits made of a mixture of Portland cement and activated charcoal, such conduits disposed horizontally in a grid pattern for the purpose of underground fluid exchange in the turf area of playing fields.

SUMMARY OF THE INVENTION

It is an object of this invention to provide a system of subsurface drainage as well as deep root irrigation that will prevent surface flooding of yards, eliminating potential home property damage. The system of this invention is attached to roof gutter down spout(s) of a building and/or the discharge pipe of a sump pump and the like and receives such flow of water drainage into an underground drainpipe within the building's yard directed away from the home. The drainpipe directs such water flow to an underground system having a vertically disposed drainage apparatus that includes a cylinder having a porous section manufactured from inert carbon material and Portland cement. Water flow passes through a pressure fitting into such porous cylinder where the water then passes through the cylinder's porous side walls into the subsurface soil. The system of this invention not only prevents water from accumulating on the surface of the yard, but also provides for deep root subsurface irrigation to trees, flowers, plants, grass as well as helping to replenish the aquifer. The system of this invention is an improvement over the use of traditional dry wells. The use of the system of this invention allows the runoff from the roof gutter down spouts and the discharge of sump pumps to be pressurized and pushed outward through the cylinder's porous side walls, and the water goes directly underground to provide water to the roots of vegetation and to prevent such water from causing surface flooding which might then carry unwanted chemicals, such as nutrients, into local streams via storm drains or to an overburdened municipal water treatment facility.

The underground drainage apparatus used in the system of this invention is a vertically disposed cylinder having porous side walls that is approximately 28 inches in height, approximately 17 inches in outer diameter and weighs approximately 150 pounds and has a life expectancy of at least 50 years.

BRIEF DESCRIPTION OF THE DRAWING

The FIGURE illustrates a perspective view of the Subsurface Drainage System of this invention.

DESCRIPTION OF THE PREFERRED EMBODIMENT(S)

The FIGURE illustrates a perspective view of the Subsurface Drainage System of this invention. Not shown are the sources of the water drainage, being roof gutter down spout(s) of a building and their extensions and/or sump pump drains and the like which are well known in the prior art. The system receives the water drainage from the above-mentioned sources and discharges the water drainage through drain pipe 20 which is buried beneath topsoil 24 of the yard of a home. One end of a downwardly directed right angle elbow pipe 18 is attached to the end of drain pipe 20 and the other end engages pressure pipe fitting 32 which directs the water drainage downward into cylinder 10 which is buried at least 15 feet from the foundation wall of the building. The water drainage passes into water drainage receipt area 16 defined in cylinder 10, the central portion of which cylinder is made of a combination of activated charcoal and Portland cement that can be selectively combined to yield a wide range of porosity and which can be uniform in such selected porosity throughout the mid-length of the side walls of the cylinder. The combination of activated charcoal and Portland cement is well known in the prior art. Cylinder 10 is constructed with a base 14 of solid concrete integrally molded together with an adjacent midsection made of a variety of sizes of activated charcoal mixed with Portland cement sufficient to create inherent permanent porosity of the vertical side walls 12 of the cylinder. The vertical side walls 12 are approximately 1.5-2.5 inches in thickness and have a multiplicity of pores 30 formed therein which are microscopic in size. Top cover 28 of cylinder 10 is also cast of concrete and is received by, and attached to, the top of vertical side walls 12. Top cover 28 is approximately 4-6 inches in height and is made of reinforced concrete to complete the cylinder. Reinforced concrete top cover 28 has a four-inch diameter ABS female pipe fitting 32 disposed within vertical aperture 40 defined in top cover 28 which aperture is absolutely centered therein and pipe fitting 32 opens through such elongated aperture 40 into water drainage receipt area 16. Pipe fitting 32 forms a pressure fitting as will be described further below. Water drainage traveling down drain pipe 20 passes through right angle elbow pipe 18 and then passes through pipe fitting 32. Right angle pipe 18 has a bottom 38 which is installed in the field into female pipe fitting 32 using a solvent weld adhesive so as to be leak-proof. The passage of water through pipe fitting 32 creates air pressure through elongated aperture 40 to the inner walls of water drainage receipt area 16 of cylinder 10 from the flow of water into vertical portion 34 of right angle elbow pipe 18. Thus pipe fitting 32, being in the absolute center of the top portion of top cover 28, acts as a pressure fitting and prevents air from escaping from receipt area 16 in cylinder 10 back up through vertical portion 34 of right angle elbow pipe 18. Because the porosity of the midsection of cylinder 10 is constant, the air pressure created by the incoming water flow helps push water drainage through the porous side walls 12 of cylinder 10. Pores 30 are microscopic channels contained in the side walls 12 of cylinder 10 which microscopic channels create capillary action to draw water through the pores and pass such liquid into the cylinder's outer surroundings.

In a preferred embodiment drain pipe 20 is buried in a 10-inch deep trench, and during installation a much larger cylindrical hole is dug that is approximately 42 inches deep with a diameter of approximately 24 inches to receive cylinder 10. In such hole an 8-inch bed of ½-¾ inch stone is first placed, and then cylinder 10 is positioned vertically disposed therein. The area around the outer perimeter of the cylinder is then filled within the hole with ½-¾ inch stone to the top of the cylinder. A vapor barrier 36, such as roofing paper or equivalent material, can be placed over elbow pipe 18 so as to cover the cylinder, and then back fill or soil is placed thereover to the top of the lawn where sod an be placed neatly over the installation. It is desirable to try to install the system of this invention in an area where subsoil 26 is a sandy gravel to allow for maximum water permeability, and the water table in the area should be a minimum of 6 inches below the lowest level of the excavation. Further, in a preferred embodiment the rate of water flow through the side walls of porous water cylinder 10 is approximately 55 gal/min. By having the water drainage flow broken up and passed through a multiplicity of pores 30 into stone 22 and then through subsoil 26, heavy water drainage flow can be widely dispersed under the surface of the yard, preventing significant water accumulation above topsoil 24. The system of this invention relies on gravity drainage and disperses the water drainage underground, thus preventing yard flooding.

Although the present invention has been described with reference to particular embodiments, it will be apparent to those skilled in the art that variations and modifications can be substituted therefor without departing from the principles and spirit of the invention.

We claim:

1. A system for water infiltration into subsoil near a building having a yard surface covered by topsoil, such building having a gutter system, sump pump or other source of water discharge directed into an underground drain pipe having a first end and a second end, said first end extending from said source of water discharge and said second end being disposed horizontally in said subsurface soil, said system comprising:

a 90-degree elbow pipe having a first end and a second end, said first end of said elbow pipe interconnected to said second end of said drain pipe and said second end of said elbow pipe extending downward; and a vertically disposed cylinder having a top, a bottom, a midsection and side walls having an outer side, said top of said cylinder interconnected to said second end of said elbow pipe which is absolutely centered therein forming a pressure fitting, said midsection made of a high-porosity material being a mixture of Portland cement and activated charcoal, said cylinder having a multiplicity of microscopic pores defined in said midsection, said cylinder having a receipt area defined therein for receiving said water from said second end of said elbow pipe and directing said water first by gravity pressure and then to flow under air pressure created by said incoming water passing through said pressure fitting to pass then through said porous midsection which, by capillary action, further draws said water through said pores and into said adjacent subsoil at a rate sufficient for dispersing said water into said subsoil to prevent yard surface flooding.

2. A system for water infiltration into subsoil near a building having a yard surface covered by topsoil, such building having a gutter system, sump pump or other source of water discharge directed into an underground drain pipe having a first end and a second end, said first end extending from said source of water discharge and said second end being disposed horizontally in said subsurface soil, said system comprising:

a 90-degree elbow pipe having a first end and a second end, said first end of said elbow pipe interconnected to said second end of said drain pipe and said second end of said elbow pipe extending downward;

a vertically disposed cylinder having a top, a bottom, a midsection and side walls having an outer side, said cylinder interconnected to said second end of said elbow pipe, said midsection made of a high-porosity material being a mixture of Portland cement and activated charcoal, said cylinder having a multiplicity of pores defined in said midsection, said cylinder having a receipt area defined therein for receiving said water from said second end of said elbow pipe and directing said water by gravity pressure to flow through said porous midsection into said adjacent subsoil at a rate sufficient for dispersing said water into said subsoil to prevent yard surface flooding;

wherein said vertically disposed cylinder further includes:

a cast concrete base having a thickness of approximately 4-6 inches forming said bottom of said cylinder;

wherein said midsection is integrally attached to said base, said midsection having side walls having a thickness of approximately 1.25-2.5 inches;

a top member made of concrete, said top member having a center and a thickness of approximately 4-6 inches, said top member attached to said midsection, the open area between said top member, said side walls and said base defining said receipt area in said cylinder;

an aperture defined in and extending vertically through said center of said top member; and a female pipe fitting positioned in said aperture, said female pipe fitting for receipt and attachment to said second end of said elbow pipe for forming a pressure fitting to prevent air escape from said receipt area and pressurizing said receipt area to aid in forcing water outward through said multiplicity of pores in said side walls of said cylinder into said surrounding subsoil.

3. The system of claim 2 further including:

a bed of ½-¾ inch stone disposed beneath said bottom of said cylinder, around said outer sides of said cylinder, and above said top member of said cylinder; and a vapor barrier positioned above said elbow pipe and covering said cylinder, said vapor barrier being covered by said topsoil.

4. The system of claim 3 wherein said porous side walls of said cylinder has sufficient porosity to allow a water flow rate therethrough of approximately 55 gallons/minute.

* * * * *